US006251571B1

(12) United States Patent
Dessauer et al.

(10) Patent No.: US 6,251,571 B1
(45) **Date of Patent: *Jun. 26, 2001**

(54) NON-PHOTOSENSITIVE, THERMALLY IMAGEABLE ELEMENT HAVING IMPROVED ROOM LIGHT STABILITY

(75) Inventors: Rolf Dessauer, Greenville; Jonathan V Caspar, Henry Clay Village, both of DE (US)

(73) Assignee: E. I. du Pont de Nemours and Company, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/037,403

(22) Filed: Mar. 10, 1998

(51) Int. Cl.[7] ..... G03C 1/73; G03C 1/815

(52) U.S. Cl. ..... 430/343; 430/332; 430/338; 430/340; 430/964

(58) Field of Search ..... 430/332, 338, 430/340, 343, 964; 346/135.1, 76.1

(56) References Cited

U.S. PATENT DOCUMENTS

| | | | |
|---|---|---|---|
| 3,042,515 | 7/1962 | Wainer | 96/48 |
| 3,042,516 | 7/1962 | Wainer | 96/48 |
| 3,383,212 | 5/1968 | Mac Lachlan | 96/48 |
| 3,390,995 | 7/1968 | Manos | 96/48 |
| 3,390,996 | 7/1968 | Mac Lachlan | 96/48 |
| 3,445,234 | 5/1969 | Cescon et al. | 96/90 |
| 3,479,185 | 11/1969 | Chambers, Jr. | 96/84 |
| 3,493,376 | 2/1970 | Fichter, Jr. | 96/90 |
| 3,563,750 | 2/1971 | Walker | 96/90 |
| 3,585,038 | 6/1971 | Cescon et al. | 96/90 |
| 3,615,454 | 10/1971 | Cescon et al. | 96/35.1 |
| 3,615,481 | 10/1971 | Looney | 96/48 |
| 3,615,567 | 10/1971 | Wilson | 96/90 R |
| 3,784,557 | 1/1974 | Cescon | 260/309 |
| 4,298,678 | 11/1981 | Mc Keever | 430/338 |
| 4,311,783 | 1/1982 | Dessauer | 430/270 |
| 4,332,884 | 6/1982 | Uji-Ie et al. | 430/338 |
| 4,356,252 | 10/1982 | Lee | 430/270 |
| 4,410,621 | 10/1983 | Wada et al. | 430/281 |
| 4,423,139 | 12/1983 | Isbrandt et al. | 430/338 |
| 4,495,020 | 1/1985 | Nakabayashi et al. | 156/314 |
| 4,551,413 | 11/1985 | Bell | 430/270 |
| 4,581,325 | 4/1986 | Kitchin et al. | 430/522 |
| 4,622,286 | 11/1986 | Sheets | 430/343 |
| 4,634,657 | 1/1987 | Holman, III | 430/281 |
| 4,656,121 | 4/1987 | Sato et al. | 430/495 |
| 4,743,091 | 5/1988 | Gelbart | 350/252 |
| 4,882,265 | 11/1989 | Laganis et al. | 430/522 |
| 4,929,530 | 5/1990 | Saeki et al. | 430/138 |
| 4,942,141 | 7/1990 | De Boer et al. | 503/227 |
| 4,962,009 | 10/1990 | Washizu et al. | 430/138 |
| 4,973,572 | 11/1990 | De Boer | 503/227 |
| 4,981,769 | 1/1991 | Saeki et al. | 430/138 |
| 5,019,549 | 5/1991 | Kellogg et al. | 503/227 |
| 5,051,333 | 9/1991 | Yanagihara et al. | 430/343 |
| 5,093,492 | 3/1992 | Acker et al. | 544/123 |
| 5,146,087 | 9/1992 | Vandusen | 250/271 |
| 5,156,938 | 10/1992 | Foley et al. | 430/200 |
| 5,171,650 | 12/1992 | Ellis et al. | 430/20 |
| 5,286,604 | 2/1994 | Simmons, III | 430/286 |
| 5,330,884 | 7/1994 | Fabricius et al. | 430/522 |
| 5,407,783 | 4/1995 | Caruso | 430/288 |
| 5,440,042 | 8/1995 | Fabricius et al. | 544/315 |
| 5,536,626 | 7/1996 | Fabricius et al. | 430/522 |
| 5,858,583 * | 1/1999 | Dessauer et al. | 430/332 |
| 5,955,224 * | 9/1999 | Caspar et al. | 430/332 |

FOREIGN PATENT DOCUMENTS

| | | | |
|---|---|---|---|
| 42 40 141 A1 | 6/1994 | (DE) . | |
| 0 243 936 A2 | 4/1987 | (EP) | G03F/7/10 |
| 335236 | 10/1989 | (EP) . | |
| 0 321 923 B1 | 7/1992 | (EP) | B41M/5/26 |
| 59-72438 | 4/1984 | (JP) | G03C/1/00 |
| 60-95430 | 5/1985 | (JP) | G03C/1/00 |
| 60-98433 | 6/1985 | (JP) | G03C/1/80 |
| 60-191238 | 9/1985 | (JP) | G03C/1/00 |
| 5-229251 | 9/1993 | (JP) | B41M/5/18 |
| 5-301448 | 11/1993 | (JP) | B41M/5/18 |
| 7/32738 | 2/1995 | (JP) | B41M/5/18 |
| 7-228051 | 8/1995 | (JP) | B41M/5/18 |
| 8-39935 | 2/1996 | (JP) | B41M/5/18 |
| 8-297364 | 11/1996 | (JP) . | |

* cited by examiner

*Primary Examiner*—Richard L. Schilling

(57) ABSTRACT

Novel thermally imageable monochrome product compositions, elements, and processes are disclosed herein. These compositions and elements characteristically have high contrast and fast imaging speeds. The thermally imageable compositions of this invention contain at least one polymeric binder, a specified leuco dye and a specified hydroxylamine compound. These compositions have the propensity for affording, upon thermal imaging, highly colored images having high optical density values. At the same time, background color is low in preferred compositions even after extensive exposure to ambient light. These compositions can be imagewise heated to effect color formation (i.e., generation of an image) or, in case of compositions containing at least one near IR-absorbing dye, can be imagewise exposed to near IR radiation from a laser or other device to effect color formation (i.e., generation of an image).

27 Claims, No Drawings

NON-PHOTOSENSITIVE, THERMALLY IMAGEABLE ELEMENT HAVING IMPROVED ROOM LIGHT STABILITY

FIELD OF THE INVENTION

This invention is related to thermally imageable, color-forming composition and elements, which are imageable with either heat and/or near infrared (near-IR) radiation, and more particularly to such elements having improved room light stability. The invention is also directed to processes for forming color images employing such compositions and elements.

BACKGROUND OF THE INVENTION

Many imaging processes utilize interactions between leuco dyes and photolytically or thermally generated oxidants. Critical characteristics for the success of these leuco dyes and oxidants include their stability and handlability during storage prior to and subsequent to imaging as well as the imaging speed of such. Often, however, increased stability results in reduced imaging speed.

The ease of oxidation of these leuco dyes often determines their imaging speed, i.e., the amount of color formed based on the applied radiation. Thus, the more easily oxidized leuco dyes form color more readily and as such can be imaged with less energy. On the other hand, the more ambiently stable leuco dyes, e.g., tris(p-diethylamino-o-tolyl)methane can be more easily handled in room light, but require considerably more energy to produce effective image color when exposed to UV-light, heat or near-IR energy when formulated in comparable systems. A balance thus exists between the ease of oxidizing the leuco dyes, with concomitant lower roomlight stability, and the use of more roomlight-stable leuco dyes which yield slower imaging systems.

Imaging systems described in the literature often contain compositions including halocarbons or halocarbonyl compounds and leuco dye(s). Compositions including hexaarylbiimidazole (HABI) compound(s) and leuco dye(s) that are imaged using ultraviolet radiation (UV means) are also known. Also available are leuco dye lactones and developers, e.g., bisphenol-A or other phenolic derivatives.

A common type of leuco dye is Leuco Crystal Violet and its analogs. The literature contains descriptions of many additives which are reported to improve the stability of these leuco dyes. Among these are phenols, hydroquinones, phenidone, hindered amines, etc.

In many systems, the use of UV-absorbing agents has been reported to enhance the handlability of the unimaged and imaged coatings. However, in many instances, the use of light filtering materials has been found to be only partially effective.

In order to form useful images, it is necessary to stabilize the imaging system, i.e., prevent color to form in the background. Systems have been described which generate an inhibitor to color-formation by exposure to light (for example, U.S. Pat. No. 3,390,996), heat (for example, U.S. Pat. No. 3,390,995) or light and heat (for example, U.S. Pat. No. 3,383,212, and U.S. Pat. No. 4,332,884).

Modifications in which encapsulation is employed to control background and/or image stability have been reported. Thus a number of patents (for example, U.S. Pat. Nos. 4,929,530, 4,962,009 and 4,981,769) describe systems in which color-formation is effected inside capsules and heat is employed to rupture these in order to make contact between the components of color formation with chemical fixing agents outside the capsules so as to stabilize the imaged areas. Here the capsules are involved in separating the imaging and fixing components and to provide a relatively stable system. All these systems require some modicum of image stabilization to prevent significant color buildup in the unimaged areas, and "add-on" of images to previously exposed image areas is difficult. There is a need for a system that does not undergo significant changes when viewed in ambient light, thus reducing the ability to form color effectively when re-exposed.

In other cases, color formation was prevented by restricting the mobility of color formation, either by use of a thermoplastic binder, which required heating of the composition before, during or subsequent to UV exposure to allow color to form (for example, U.S. Pat. No. 3,615,481). A system also described stabilization of background after color-formation as a result of a subsequent polymerization step, effected by light or heat (for example, U.S. Pat. No. 3,615,454) which locked the color-forming components in place.

The thermally imageable compositions that are known use high levels of phenolic compounds with relatively reactive leuco dyes for improved stability. It has been found that high levels of the phenolic compounds do not give the required level of room light stability. The leuco dyes such as Leuco Crystal Violet which provide a more intense, visually more attractive color are limited in their use because of the ease with which these may be air oxidized. Also, the high levels of stabilizer required increase cost.

Hence, there has been a search for stabilizers which allow the formulation to include the more readily oxidized leuco dyes. Specifically, the search often focused on those which involve the stabilization of the leuco dye itself, rather than those which interact with one of the image-generating oxidants. However, a need still exists for a non-photosensitive, thermally sensitive compositions that exhibit good imaging speed in addition to having good room light stability.

SUMMARY OF THE INVENTION

The present invention provides in one embodiment, a non-photosensitive, imageable composition having improved room light stability comprising:

(a) at least one polymeric binder;

(b) at least one leuco dye selected from aminotriarylmethanes, aminoxanthenes, aminothioxanthenes, amino-9,10-dihydroacridines. aminophenoxazines, aminophenothiazines, aminodihydrophenazines, aminohydrocinnamic acids (cyanoethanes, leuco methines) and corresponding esters, 2(p-hydroxyphenyl)-4,5-diphenylimidazoles, indanones and combinations thereof;

(c) at least one hydroxylamine compound selected from:

(i) compounds having the following structure:

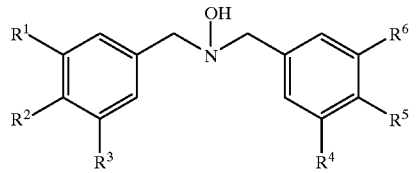

wherein each of $R^1$ through $R^6$ are independently selected from hydrogen; hydroxyl; amino; C1–C6 alkyl; C1–C6 alkoxy; halogen such as F, Cl, Br, etc.; $NO_2$; and wherein any two adjacent $R^1$ through $R^3$ and any two adjacent $R^4$ through $R^6$ may form a fused aryl ring; and (ii) compounds having the following structure:

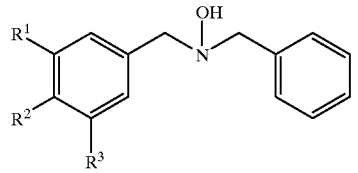

wherein each of $R^1$ through $R^3$ are independently selected from the group consisting of hydrogen; hydroxyl; amino; C1–C6 alkyl; C1–C6 alkoxy; halogen such as F, Cl, Br, etc.; $NO_2$; and wherein any two adjacent $R^1$ through $R^3$ may form a fused aryl ring; and combinations of (i) and (ii).

In another embodiment of the present invention, the non-photosensitive, imageable composition having improved room light stability comprises:

(a) an inert organic medium;

(b) at least one leuco dye selected from aminotriarylmethanes; aminoxanthenes; aminothioxanthenes; amino-9,10-dihydroacridines. aminophenoxazines; aminophenothiazines; aminodihydrophenazines; aminohydrocinnamic acids; esters of aminohydrocinnamic acids; 2(p-hydroxyphenyl)-4,5-diphenylimidazoles; indanones and combinations thereof;

(c) at least one hydroxylamine compound selected from:

(i) compounds having the following structure:

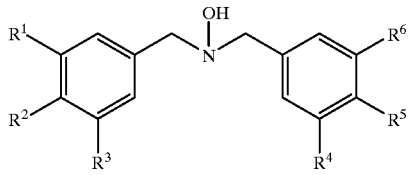

wherein $R^1$ through $R^6$ are independently selected from hydrogen; hydroxyl; amino; C1–C6 alkyl; C1–C6 alkoxy; halogen; $NO_2$; and wherein any two adjacent $R^1$ through $R^3$ and any two adjacent $R^4$ through $R^6$ may form fused aryl ring; and (ii) compounds having the following structure:

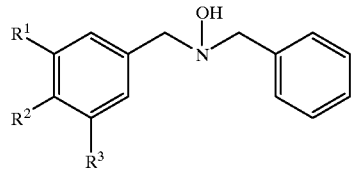

wherein $R^1$ through $R^3$ are independently selected from hydrogen; hydroxyl; amino; C1–C6 alkyl; C1–C6 alkoxy; halogen; $NO_2$; and wherein any two adjacent $R^1$ through $R^3$ may form a fused aryl ring; and combinations of (i) and (ii); wherein the components are in encapsulated form.

The non-photosensitive composition further comprises an oxidant. In another embodiment a near IR absorbing dye is present in the composition. For the near IR-absorbing dye structures useful in this invention that are substituted, the substitution of alkyl, aryl, or aralkyl groups independently can be with substituents that include, but are not limited to, hydroxy, alkoxy, chloro, bromo, cyano, and amino. In still another embodiment UV stabilizers may be present in the composition.

Unexpectedly, the composition of the present invention inhibits imaging due to exposure to room light while at the same time does not substantially affect the thermal imaging speed.

Unless otherwise stated, all percentages listed are amounts by dry weight of the total composition.

The invention itself, together with further objects and attendant advantages, will best be understood by reference to the following detailed description, taken in conjunction with the accompanying drawings.

DETAILED DESCRIPTION OF THE PREFERRED EMBODIMENT

In one embodiment of the present invention, the non-photosensitive, thermally imageable composition having improved room light stability comprises at least one polymeric binder, at least one leuco dye and at least one specified hydroxylamine compound. Each of these components is discussed in greater detail below. By "non-photosensitive" we include compositions wherein the intended imaging is thermal and simultaneously adventitious background color formation due to UV and visible light is minimized.

A thermally imageable composition as defined herein is a composition in which the imaging is completely effected by thermal means, which can be either direct heating of the composition (mode 1) or, in case of compositions containing at least one near IR-absorbing dye, color can also be formed by exposure of the composition to near IR radiation (mode 2). No other type of radiation, such as ultraviolet (UV) is required or utilized in the compositions, elements, and processes of this invention, and provisions are made to exclude UV means for imaging in this invention.

The thermally imageable compositions of this invention are sensitive to heat in that colored images are formed upon heating the compositions above a certain minimum temperature required to activate color formation process(es). In sharp contrast, prior art compositions, such as those disclosed in Caruso, U.S. Pat. No. 5,407,783, differ fundamentally from the present compositions, since the former compositions are designed to be thermally stable, and the colored images are generated in an exposure step to ultraviolet radiation (UV means).

The compositions and elements of this invention can be effectively used to permit formation of add-on images. Add-on images are defined to be those images which are either created or intensified in optical density when a second or later exposure to heat and/or near infrared radiation is made at a time subsequent to the first exposure which generated the initial image. In some areas of the graphic arts, it is desirable to form images, inspect these, and add further images subsequently. Where images are developed by overall heating or stabilized by photodeactivation, formation of add-on images in acceptable density is not possible. In the compositions/elements of this invention, the images can be viewed and added to by exposure to thermal or infrared energy.

Polymeric Binder

Various binders can be used in the compositions of this invention. Suitable binders include, but are not limited to, acrylic homopolymers, such as poly(C1–C4 alkyl acrylates); acrylic copolymers, such as copolymers of ethyl acrylate with other acrylic and methacrylic comonomers; methacrylic homopolymers, such as poly(methyl methacrylate);

methacrylic copolymers, such as copolymers of methyl methacrylate with other methacrylic and acrylic comonomers; poly(vinyl butyral); cellulose esters, such as cellulose acetate butyrate; poly(alkylene oxides), such as poly (ethylene oxide); and poly(styrene) homopolymer and copolymers, such as brominated poly(styrene).

The preferred binders are cellulose acetate esters and poly(vinyl butyral).

Leuco Dye:

The leuco form of the dye(s) which comprise(s) one component of the thermal imaging composition(s) of the present invention are selected from aminotriarylmethanes, aminoxanthenes, aminothioxanthenes, amino-9,10-dihydroacridines, aminophenoxazines, aminophenothiazines, aminodihydrophenazines, aminohydrocinnamic acids (cyanoethanes, leuco methines) and corresponding esters, 2(p-hydroxyphenyl)-4,5-diphenylimidazoles, indanones and combinations thereof.

It is the reduced form of the dye having one or two hydrogen atoms, the removal of which together with an additional electron in certain cases produces the dye. Such leuco dyes have been described, for example, in U.S. Pat. No. 3,445,234, column 2, line 49 to column 8, line 55, the content of which is incorporated herein by reference.

Aminotriarylmethanes are preferred. A general preferred aminotriarylmethane class is that wherein at least two of the aryl groups are phenyl groups having an $R^1R^2N$-substituent in the position para to the bond to the methane carbon atom wherein each of $R^1$ and $R^2$ are independently selected from hydrogen, C1–C10 alkyl, 2-hydroxyethyl, 2-cyanoethyl, and benzyl and the third aryl group may be the same as or different from the first two, and when different, is selected from the following:

(a) Phenyl which can be substituted with lower alkyl, lower alkoxy, chloro, diphenylamino, cyano, nitro, hydroxy, fluoro or bromo;

(b) Naphthyl which can be substituted with amino, di-lower alkylamino, alkylamino;

(c) Pyridyl which can be substituted with alkyl;

(d) Quinolyl;

(e) Indolinylidene which can be substituted with alkyl.

Preferably, $R_1$ and $R_2$ are hydrogen or alkyl of 1–4 carbon atoms.

Examples of category (a) aminotriarylmethane leuco dyes are illustrated by chemical structures I through VII below. Within this category (a) of aminotriarylmethane leuco dyes, suitable aminotriarylmethane leuco dyes include, but are not limited to, LCV, D-LCV, LECV, D-LECV, LPCV, LBCV, LV-1 aminotriarylmethane leuco dyes having different alkyl substituents bonded to the amino moieties wherein each alkyl group is independently selected from C1–C4 alkyl, and aminotriarylmethane leuco dyes comprising any of the preceding named structures that are further substituted with one or more alkyl groups on the aryl rings wherein the latter alkyl groups are independently selected from C1–C3 alkyl. (The chemical names for each of these aminotriarylmethane acronyms are listed in the Examples glossary below.) Preferred aminotriarylmethane leuco dyes according to this invention are LCV, D-LCV, D-LECV, LV-1 and D-LV-1. The more preferred aminotriarylmethane leuco dyes in this invention are LCV and LV-1.

The preferred triphenylmethane leuco dyes are represented by the following formulae: Leuco Crystal Violet (Structure Ib), Deutero-Leuco Crystal Violet (Structure IIb), Leuco Ethyl Crystal Violet (Structure Ic), Deutero Leuco Ethyl Crystal Violet (Structure IIc), and the mono-methyl LCV (i.e., all R and $X^2$ groups are $CH_3$) (Structure Ie) and its deutero analog (Structure IIe, wherein all R groups are $CH_3$).

I

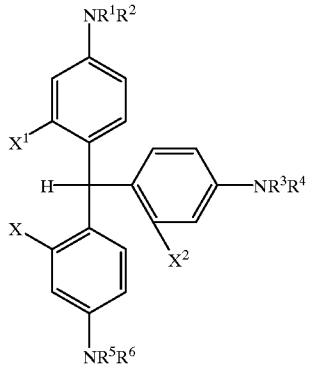

II

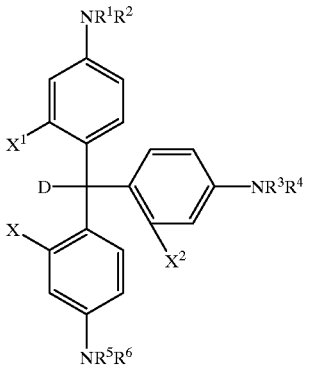

For chemical structures I and II:

a) X, $X^1$ and $X^2$ are H; $R^1$ through $R^6$ are H.

b) X, $X^1$ and $X^2$ are H; $R^1$ through $R^6$ are $CH_3$.

c) X, $X^1$ and $X^2$ are H; $R^1$ through $R^6$ are $C_2H_5$.

d) X, $X^1$ and $X^2$ are H; $R^1$ through $R^6$ are independently selected from H and C3–8 alkyl.

e) X and $X^1$ are H; $X^2$ is $CH_3$; $R^1$ through $R^6$ are independently selected from H and C1–C8 alkyl.

f) X is H; $X^1$ and $X^2$ are $CH_3$; $R^1$ through $R^6$ are independently selected from H and C1 –C8 alkyl.

g) X, $X^1$ and $X^2$ are H; $R^1$, $R^3$ and $R^5$ are independently selected from aryl C6–C10; substituted C6–C10 aryl; and $R^2$, $R^4$, and $R^6$ are H.

III

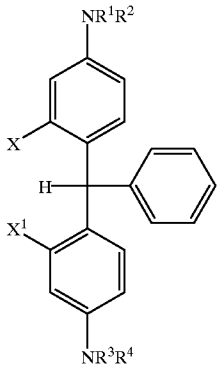

-continued

IV

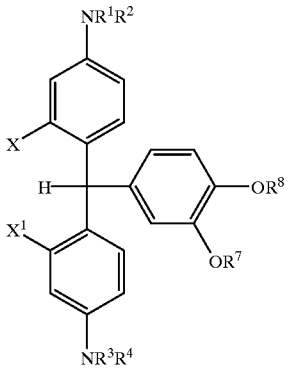

V

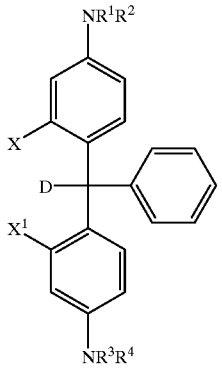

VI

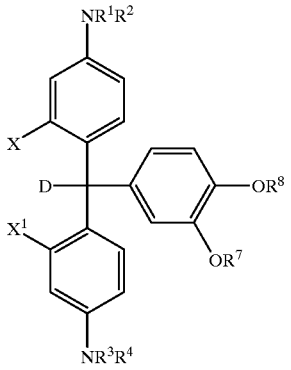

For chemical structures III through VI:

a) X and $X^1$ are H; and $R^1$ through $R^4$ are independently selected from H and C1–C8 alkyl b) X, $X^1$=H and $R^1$ and $R^3$ are aryl; and $R^2$ and R4 are H c) X=$CH_3$, $X^1$=H and $R^1$ through $R^4$ are independently selected from H and C1–C8 alkyl; and $R^7$ and $R^8$ are independently selected from C1–C8 alkyl, or $R^7$ and $R^8$ or are bridged to form a cyclic attachment with a $CH_2$— or $C_2H_4$-bond, thereby forming a five- or six-membered ring, respectively.

VII

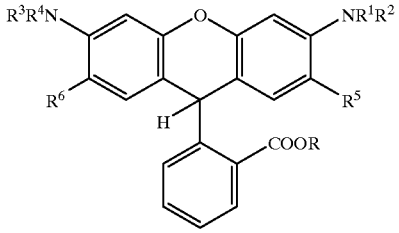

For chemical structure VII:

a) R is independently selected from H, C1–C8 alkyl; $R^5$ and $R^6$ are independently selected from H and C1–C4 alkyl; $R^1$ through $R^4$ are independently selected from H and C1–C6 alkyl, C6–C10 aryl with the proviso that, if $R^1$ and $R^3$ are aryl, then $R^2$ and $R^4$ are hydrogen.

Preferred leuco dyes in this invention include, but are not limited to, aminotriarylmethanes and aminoxanthenes.

The leuco dye(s) can be present in the compositions in the amount of at least about 3% by weight, preferably about 4 to about 20% by weight.

Hydroxylamine Compound

The hydroxylamine compound for use in this invention is present in the photosensitive composition to provide room light stability. One class of hydroxylamine compounds has the following structure (VIII):

(VIII)

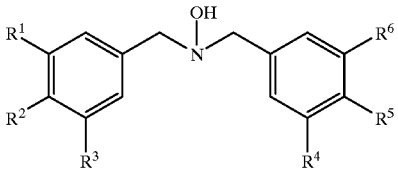

wherein $R^1$ through $R^6$ are independently selected from hydrogen; hydroxyl; amino; C1–C6 alkyl; C1–C6 alkoxy; halogen such as F, Cl, Br, etc.; $NO_2$; and wherein any two adjacent $R^1$ through $R^3$ and any two adjacent $R^4$ through $R^6$ can form a fused aryl ring. Some useful compounds include, for example, N,N-dibenzylhydroxylamine; N,N-bis(p-chlorobenzyl)hydroxyl-amine; N,N-bis(p-methylbenzyl) hydroxylamine; N,N-bis(p-fluorobenzyl)-hydroxylamine; N,N-bis(p-nitrobenzyl)hydroxyl-amine; N,N-bis(p-ethylbenzyl)hydroxylamine; N,N-bis(p-methoxybenzyl) hydroxyl-amine; N,N-bis(p-bromobenzyl)-hydroxylamine; N,N-bis(p-trifluoromethylbenzyl)-hydroxylamine; and N,N-bis(1-naphthyl-methyl)hydroxylamine.

Another class of hydroxylamine compounds has the following structure (IX):

(IX)

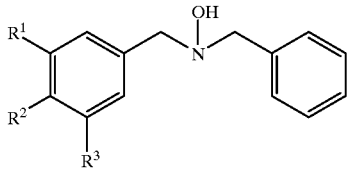

wherein each $R^1$ through $R^3$ are independently selected from hydrogen; hydroxyl; amino; C1–C6 alkyl; C1–C6 alkoxy; halogen such as F, Cl, Br, etc.; $NO_2$; and fused aryl ring. Some useful compounds include N-hydroxy-4-methyl-N-(phenylmethyl)-benzenemethanamine; N-hydroxy-3-methyl-N-(phenylmethyl)-benzenemethanamine; N-hydroxy-2-methyl-N-(phenylmethyl)-benzenemethanamine; N-hydroxy-4-ethyl-N-(phenylmethyl)-benzenemethanamine; N-hydroxy-4-propyl-N-(phenylmethyl)-benzenemethanamine; N-hydroxy-4-butyl-N-(phenylmethyl)-benzenemethanamine.

The hydroxylamine compound can be present in the amount of at least about 6% by weight, preferably of from about 6 to about 20% by weight, and more preferably of from about 7 to about 15% by weight.

Oxidant

In a preferred embodiment, the composition of the present invention includes an oxidation system.

Oxidants useful in the present invention are known as the hexaarylbiimidazoles, which includes certain 2,4,5,2',4',5'-hexaarylbiimidazole (HABIs). A HABI oxidation system includes at least one HABI compound which furnishes free-radicals when thermally activated. Thermal activation to generate the free-radicals can be effected either 1) by direct heating or 2) by exposure to near infrared (near-IR) radiation when the compositions contain in addition a suitable near-IR dye. In the imaging systems of this invention, the generation of free-radicals is necessary to result in formation of an image, such as, for example, by leuco dye oxidation to form color. In the compositions, elements, and processes of this invention which involve exposure to near-IR radiation, the radiation employed for imaging is limited to near-IR means and with the proviso that imaging is not effected using UV means.

Certain substituted 2,4,5,2',4',5'-hexaarylbiimidazole (HABIs) useful in this invention are disclosed in: Chambers, U.S. Pat. No. 3,479,185; Cescon, U.S. Pat. No. 3,784,557; Dessauer, U.S. Pat. No. 4,311,783; and Sheets, U.S. Pat. No. 4,622,286, which patents are incorporated herein by reference. The HABIs disclosed in these and related patents are substituted in the 2 and 2' rings (for example, o-chloro (o-Cl) or o-alkoxy (o-OR, where R is selected from C1–C8 alkyl)), hexaphenylbiimidazoles in which the other positions on the phenyl radicals are unsubstituted or substituted with chloro, methyl or methoxy, such as:

CDM-HABI 2,2'-bis(2-chlorophenyl)-4,4',5,5'-tetrakis(3-methoxyphenyl)-2,1'-bi-1H-midazole =2-(o-chlorophenyl)-4,5-bis(m-methoxyphenyl)imidazole dimer o-Cl-HABI 2,2'-bis(2-chlorophenyl)-4,4',5,5'-tetraphenyl-1,1'-bi-1H-imidazole o-Me HABI 2-(2-methylphenyl)-2'-[2-(2-methylphenyl)-4,5-diphenyl-2H-imidazol-2-yl]-4,5-diphenyl-1H-imidazole o-OEt-HABI 2,2'-bis(2-ethoxyphenyl)-4,4',5,5'-tetrapheny2'1,1,'-bi-1H-imidazole TCDM-HABI "trichlorodimethoxy-hexaarylbiimidazole"=2,2',5-tris(2-chlorophenyl)-4-(3,4-dimethoxyphenyl)-4',5'-diphenylbiimidazole (and isomers);

TCTM-HABI 2,2',4,4'-tetra(2-chlorophenyl)-5,5'-bis(3,4-dimethoxyphenyl)-2',1'-bi-1'-1H-imidazole Other HABIs having naphthalenyl (naphthyl) substitution, such as those listed below, are useful in this invention.

N-HABI 2,2'-di(2'-naphthalenyl)-4,4',5,5'-tetraphenyl-1,1'-bi-1H-imidazole

MCN-HABI 2,2'-bis(1-naphthalenyl)-4,4'-bis(2-chlorophenyl-5,5'-bis(3-methoxyphenyl)-2',1'-bi-1H-imidazole MN-HABI 2,2'-bis(1-naphthalenyl)-4,4',5,5'-tetrakis(3-methoxyphenyl)-2,1'-bi-1H-imidazole Some suitable HABI compounds for this invention include, but are not limited to, all those listed in this specification. HABIs may be used in combination with another, for example, a mixture of o-Cl-HABI and o-OEt-HABI.

Preferred HABI compounds (HABIs) for this invention include, but are not limited to, N-HABI, and o-OEt-HABI.

It is understood that isomers of the listed compounds are also useful.

The HABI compounds can be present in this invention in the amount of from about 6 to about 45% by weight, preferably from about 20 to about 40 percent by weight, more preferably from about 25 to about 38 percent by weight.

Near IR-absorbing Dye

In the imageable embodiments of this invention involving exposure to near-IR radiation to effect imaging, at least one near IR-absorbing dye is present in the compositions to absorb near IR radiation, which is subsequently converted to heat (thermal energy). The heat produced in this manner is predominantly or exclusively responsible for initiation of the color forming reaction(s) that occur in forming the image. Although not wishing to be bound by theory, it is believed that the heat produced subsequent to absorption of near IR radiation by a given imageable composition of this invention results in the thermal cleavage of the hexaarylbiimidazole compound(s) and the generation of triarylimidazolyl (lophyl) radicals and/or activation of the acid-generating compound to produce acid. The triarylimidazolyl radicals in synergistic combination with the products of the thermal decomposition of the acid-generating compound in turn initiate the color-forming reaction(s) involving oxidation of at least one leuco dye to its corresponding colored (dye) form. Additionally, the increase in temperature affords both decreased local viscosity within the coating resulting in enhanced diffusion of the active species and increased rates of reaction of these species.

A variety of different near IR-absorbing dyes that are effective in absorbing near IR radiation and converting it efficiently to heat (thermal energy) can be employed in this invention. Specific suitable near IR-absorbing dyes for this invention include, but are not limited to, DF-1, SQS, RD-1 as defined below.

DF-1 2-[2-[2-chloro-3-[(1,3-dihydro-1,3,3-trimethyl-2H-indol-2-ylidene)ethylidene]-1-cyclopenten-1-yl]ethenyl]-1,3,3-trimethyl-3H-indolium trifluoromethanesulfonate (see U.S. Pat. No. 4,882,265)

RD-1 Cyasorb® IR-165 Near IR Dye, American Cyanamid Co., Wayne, N.J. 07470 (absorption maximum at 1070 nm)

SQS 4[[3-[[2,6-bis(1,10-dimethylethyl)-4H-thiopyran-4-ylidene]methyl]-2-methyl]2-hydroxy-4-oxo-2-cyclobuten-1-ylidene]methyl-2,6-bis(1,1-dimethylethyl)thiopyrilium hydroxide, inner salt, Pisgah Labs, Pisgah Forest, N.C.

DF-1 and RD-1 are preferred near IR-absorbing dyes, and DF-1 is more preferred.

In addition to specific dyes as listed above, other suitable near IR dyes for this invention include, but are not limited to, those shown below:

1. Heptamethine cyanine dyes having a chemical structure (X) as shown below:

(X)

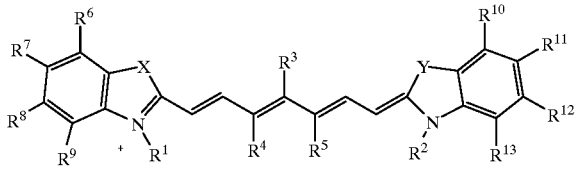

where $R^3$ can be H, halogen, alkyl, aryl, alkoxy, aryloxy, thioalkyl, or thioaryl; $R^4$ and $R^5$ are independently selected from H, alkyl, aryl, or are bridged to form a cyclic attachment; each of $R^6$ through $R^{13}$ is independently selected from H, alkyl, aryl, or any two adjacent $R^6$ through $R^9$ and any two adjacent $R^{10}$ through $R^{13}$ can form a fused aryl; each of $R^1$ and $R^2$ are independently selected from alkyl, aryl and substituted alkyl; X and Y, which may or may not be identical, are each represented by the formula CR'R" where R', R" are independently selected from H, C1–C6 alkyl, O, S, Se and Te. Choice of counterion for cationic dyes is dictated mainly by solubility requirements. Acceptable counterions include but are not limited to triflate, tosylate, perchlorate, hexafluorophosphate, tetrafluoroborate, iodide, chloride, bromide.

2. Benzenaminium dyes having a chemical structure (X) as shown below:

(XI)

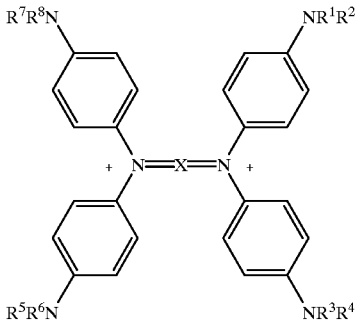

wherein each of $R^1$ through $R^8$ is independently selected from C1–C6 alkyl; X is a substituted 1,4-cyclohexadiene.

3. Squarylium dyes having structure (XII) or structure (XIII) as shown below:

(XII)

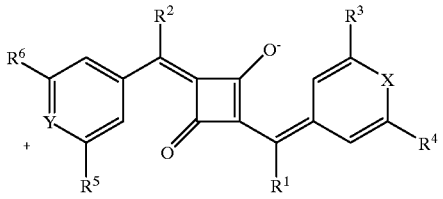

wherein each of $R^1$ and $R^6$ is independently selected from H, C1–C6 alkyl; X and Y are independently selected from O, S, Se, Te, N—$R^7$, wherein $R^7$ is selected from C1–C6 alkyl.

(XIII)

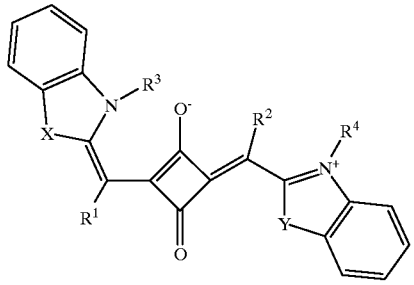

wherein each of $R^1$ and $R^2$ is independently selected from H, C1–C6 alkyl; each of X and Y is independently selected from O, S, Se, Te, N—$R^7$, wherein $R^7$ is selected from C1–C6 alkyl; each $R^3$ and $R^4$ is independently selected from alkyl, aryl or substituted alkyl. The benzene rings in structure (XIII) may be further substituted.

With respect to the choice of near IR-absorbing dye in a given composition of this invention, the following factors are significant:

The amount of thermal energy generated is dependent on the efficiency of conversion of the near IR radiation to heat, which varies from one near IR dye to another near IR dye and which depends upon structural considerations.

The efficiency of the near IR dye is related to the overlap of the emission of the near IR source and the absorption characteristics of the dye.

The near IR-absorbing dye when present in this invention is present in the amount of from about 1 to about 10% by weight, preferably from about 1 to about 5% by weight.

Additives

Various types of acid-generating compounds can be employed in the compositions of this invention individually and in combination with each other. The acid-generating compounds are those that react under thermolytic conditions, including direct heating and exposure to near-IR radiation, to afford explicit acid or to generate radicals which form acids. Acid-generating compounds that are effective in this invention include many halogenated compounds, particularly brominated compounds. Preferred acid-generating compounds include BMPS, DBTCE, DBC, and TCT (as defined below). The most preferred acid-generating compound is BMPS.

BMPS phenyl tribromomethyl sulfone

DBTCE 1,2-dibromotetrachloroethane

DBC dibromochalcone (dibromobenzylidene acetophenone)

TCT tristrichloromethyltriazine

UV stabilizers can also be employed in the compositions of this invention to afford further improvement in room light stability. Effective UV stabilizers for this invention are those that absorb significantly at wavelengths greater than 380 nm. Three classes of UV stabilizers that are effective in this invention are, but are not limited to, polyhydroxybenzophenones, triarylimidazoles, and hydroxyphenylbenzotriazoles. Some suitable UV stabilizers for this invention include, but are not limited to, DMDHBP, THBP, THDBBP, DHMBP, and DPCPI (as defined below). Preferred UV stabilizers in this invention are THBP and THDBBP DMDHBP 4,4'-dimethoxy-2,2'-dihydroxybenzophenone THBP 2,2',4,4'-tetrahydroxybenzophenone THDBBP 2,2',4,4'-tetrahyrodxy-5,5'-di-t-butylbenzophenone DHMBP 2,2'-dihydroxy-4-methoxybenzophenone DPCPI 4,5-diphenyl-2(o-chlorophenyl)imidazole Preferred compositions of this invention include at least one UV stabilizer. UV stabilizer levels can range from about 0.1 to about 20 weight percent. Preferred UV stabilizer levels are in the range of from about 1 to about 15 weight percent, and more preferred UV stabilizer levels are in the range of from about 3 to about 10 weight percent. More than one UV stabilizer can be employed. When more than one UV stabilizer is employed, the ranges given above apply to each UV stabilizer individually, with the maximum level for the total of all UV stabilizer levels being about 30 weight percent.

Optionally, other additives can be present in the thermally imageable compositions of this invention. For example, the thermally imageable compositions can also contain inert infusible fillers such as titanium dioxide, organophilic colloidal silica, bentonite, powdered glass, micro-sized alumina and mica in minor, noninterfering amounts. Formulations containing micro-sized silicas, as, for example, the SYLOID silica gels, sold by W. R. Grace & Co., are particularly useful for providing a "tooth" for pencil or ink receptivity and eliminating blocking tendencies.

In preparing the compositions for application onto a substrate, inert solvents are generally employed which are volatile at ordinary pressures. Examples include alcohols and ether alcohols such as methanol, ethanol, 1-propanol, 2-propanol, butanol, and ethylene glycol; esters such as methyl acetate and ethyl acetate; aromatics such as benzene, o-dichlorobenzene and toluene; ketones such as acetone, methyl ethyl ketone (butanone-2) and 3-pentanone; aliphatic halocarbons such as methylene chloride; chloroform; 1,1,2-trichloroethane; 1,1,2,2-tetrachloroethane and 1,1,2-trichloroethylene; miscellaneous solvents such as dimethylsulfoxide, pyridine, tetrahydrofuran, dioxane, dicyanocyclobutane and 1-methyl-2-oxo-hexamethyleneimine; and mixtures of these solvents in various proportions as may be required to attain solutions. It is understood that the amount of solvent needed is dependent upon the amount of dry components present in the composition, and can be determined by routine experimentation.

Some useful optional antiblocking agents present to prevent the coatings from adhering to one another include $CF_3(CF_2CF_2)_{17}CH_2CH_2—O—C(=O)(CH_2)_{16}CH_3$ and other known agents.

There are no limitations on the amounts of optional components in this invention.

Materials of Construction

In forming a monochrome proofing product according to this invention, the thermally imageable compositions are frequently coated onto paper substrates. Both coated and uncoated cellulosic and synthetic papers can be employed in this invention. On paper, and other opaque substrates, coatings may be applied to one or both sides. Other substrates can also be employed in this invention; these include, but are not limited to, polyolefins, polyesters, such as poly(ethylene terephthalate), and filled polyesters.

Manufacturing Process

The process of formation of an imageable dry coating is relatively simple and direct. The stable liquid imageable composition(s) of the present invention is coated onto a substrate. Various methods of coating can be employed which are well known in the art.

Substantially all solvent(s) in the liquid composition is removed which results in a dry film.

Alternatively, the components of the imaging system may be encapsulated, and components of the fixing chemistry can be separately encapsulated. A mixture of such capsules can then be jointly coated onto an opaque support. This embodiment of the invention provides a non-photosensitive, thermally imageable composition having improved room light stability comprising:

(a) an inert organic medium, for example an organic medium selected from phosphoric esters, phthalic esters, acrylic esters, methacrylic esters, other carboxylic acid esters, fatty acid amides, alkylated biphenyls, alkylated terphenyls, chlorinated paraffin, alkylated napthalenes, diarylethanes and combinations thereof. Preferably the organic medium is a phthalic ester;

(b) at least one leuco dye selected from aminotriarylmethanes; aminoxanthenes; aminothioxanthenes; amino-9,10-dihydroacridines; aminophenoxazines; aminophenothiazines; aminodihydrophenazines; aminohydrocinnamic acids; esters of aminohydrocinnamic acids; 2(p-hydroxyphenyl)-4,5-diphenylimidazoles; indanones and combinations thereof;

(c) at least one hydroxylamine compound selected from:

(i) compounds having the following structure:

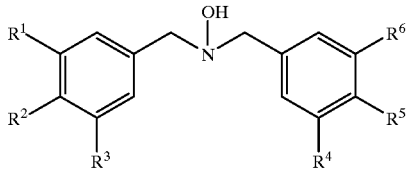

wherein $R^1$ through $R^6$ are independently selected from hydrogen, hydroxyl, amino, C1–C6 alkyl, C1–C6 alkoxy, halogen such as F, Cl, Br, etc., $NO_2$; and wherein any two adjacent $R^1$ through $R^3$ and any two adjacent $R^4$ through $R^6$ may form a fused aryl ring; and (ii) compounds having the following structure:

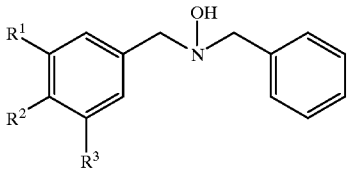

wherein $R^1$ through $R^3$ are independently selected from hydrogen, hydroxyl, amino, C1–C6 alkyl, C1–C6 alkoxy, halogen such as F, Cl, Br, etc., $NO_2$; and wherein any two adjacent $R^1$ through $R^3$ may form a fused aryl ring; and combinations of (i) and (ii); wherein the components are in encapsulated form.

Coatings can be applied on one or both sides of preferred substrates to afford one-sided or two-sided papers or films, especially papers or filled polyester films to permit formation of two-side exposed thermal images.

Process of Use

Thermally imageable compositions of this invention may be used to prepare monochrome prints by applying heat via any device capable of delivering heat to a substrate in an imagewise fashion. Examples of devices include, but are not limited to, thermal heads and thermal styli. This application is useful in the printing of labels, receipts and output, where instant accessibility is desired, as for example in medical information printout systems.

Other thermally imageable compositions of this invention, containing NIR-absorbing dyes may be used to prepare monochrome proofing products in print-engines which depend on NIR-emitting lasers as exposure devices.

All such compositions can be applied to a substrate by coating a liquid dispersion or solution. After optional drying, if needed and selected, the coating is either imagewise heated thermally or, in case of a coating containing a near IR-absorbing dye, imagewise exposed to near infrared (NIR) radiation to effect creation of an image.

For the latter case involving imagewise exposure to near IR radiation, exposure is made with one or more near infrared emitting lasers or other devices that generate near IR radiation. The compositions used in the process of the invention generally exhibit their maximum sensitivity in the near infrared (near IR) range, which is approximately 770–1500 nm. Therefore the radiation source should furnish an effective amount of this type of radiation. Suitable radiation sources include diode lasers, e.g., gallium arsenide lasers emitting at 830 nm and Nd-YAG lasers emitting at 1064 nm.

When laser radiation sources are employed, the exposure times can be short, e.g., milliseconds or less, and with no upper limit.

Specifically in one embodiment, the invention is a thermal process for preparing an image on a substrate comprising, in order:

(i) forming an imageable layer on the substrate, wherein the imageable layer comprises:
  (a) at least one polymeric binder;
  (b) at least one leuco dye selected from aminotriarylmethanes; aminoxanthenes; aminothioxanthenes; amino-9,10-dihydroacridines; aminophenoxazines; aminophenothiazines; aminodihydrophenazines; aminohydrocinnamic acids; esters of aminohydrocinnamic acids; 2(p-hydroxyphenyl)-4,5-diphenylimidazoles; indanones and combinations thereof;
  (c) at least one hydroxylamine compound selected from:
    (i) compounds having the following structure:

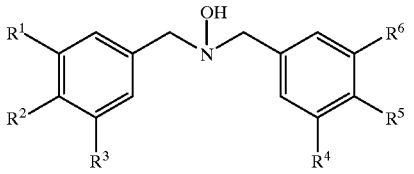

wherein $R^1$ through $R^6$ are independently selected from hydrogen; hydroxyl; amino; C1–C6 alkyl, C1–C6 alkoxy, halogen such as F, Cl, Br, etc., $NO_2$; and wherein any two adjacent $R^1$ through $R^3$ and any two adjacent $R^4$ through $R^6$ may form a fused aryl ring; and (ii) compounds having the following structure:

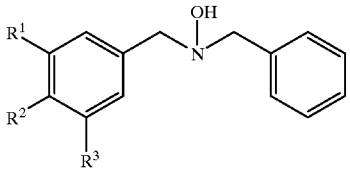

wherein $R^1$ through $R^3$ are independently selected from hydrogen, hydroxyl, amino, C1–C6 alkyl, C1–C6 alkoxy, halogen such as F, Cl, Br, etc. $NO_2$; and wherein any two adjacent $R^1$ through $R^3$ may form a fused aryl ring; and combinations of (i) and (ii);

(ii) imagewise heating the imageable layer to form imaged and non- imaged areas and to thereby form an image on the substrate, wherein the imagewise heating of the composition is by thermal means using mode 1 with the proviso that the composition is not exposed by UV means. The imageable layer is formed by coating or laminating an imageable composition on the substrate. If the layer is formed by lamination care should be taken that the lamination temperature is not high enough to cause imaging of the imageable layer.

Specifically in one other embodiment, the invention is a near infrared radiation activated process wherein the imageable layer further comprises at least one near IR-absorbing dye, and imaging is accomplished by imagewise exposing the layer with near-IR radiation to form intensely colored areas and providing contrast over the non-exposed areas to thereby form an image on the substrate, wherein the imagewise exposing of the imageable layer is effected entirely by thermal means involving exposing with near-IR radiation using mode 2 with the proviso that the imagewise exposing of the imageable layer is not imaged by UV means.

This makes it possible to obtain quickly without additional processing, high quality, high contrast images which simulate the image quality of the electronically stored image which subsequently may be used to produced lithographic printing plates in the same or similar print engines. Such plates generally require development prior to showing an image and in addition are more costly than proofing papers of this invention.

The exposed proofs can thus be examined by the user, to determine if plates generated from the electronically stored information will yield the desired print information and quality. They can be used in ambient light without significant deterioration.

In practice of use, it is often desirable to produce two-sided proofs. With these, subsequent to forming signatures (booklets), it is possible to approximate more closely the final printed document, when this is a multipage document. The materials of the process of this invention lend themselves to the manufacture and use of two-sided proofing products.

It is sometimes desirable to impose multiple images on a proofing product. It is feasible in analog proofing to use different intensities of irradiation to form differently intense dye images (color breaks) with different lithographic negatives (which subsequently are exposed to give plates which are used to print different colors) to denote the image that is generated with black ink, magenta ink, etc. With the proofing products of this invention, images can be formed with a lower level of irradiance, e.g., 250 vs. 450 mJ/cm$^2$ to show similar effects. This is an illustration of a color break.

Illustrations of add-on images which are important can thus be given. It may be desirable, e.g., to use the same text but different illustrations on proofs, to illustrate what the ultimate print will look like. Thus a set of proofs can be made via a laser exposure unit (e.g., a CREO unit) with the same signal, and after having been viewed, these can subsequently be re-exposed via the with information which will result in the imposition of pictorial information. Thus, two or more images can be imposed on the same proofing product sequentially, and because the images are instantly accessible, they can be evaluated between exposures. This is an example of imposition printing.

GLOSSARY*

Leuco Dyes

- LCV Leuco Crystal Violet; tris(N,N-dimethylaminophenyl)methane=4,4',4"-methylidynetris(N,N-dimethyl)benzenamine
- LECV tris(N,N-diethylaminophenyl)methane=4,4',4"-methylidynetris(N,N-diethyl)benzenamine
- LV-2 bis(4-diethylamino-2-methylphenyl)(4-diethylaminophenyl)methane
- LV-1 bis(4-diethylaminophenyl)-(4-diethylamino-2-methyl-phenyl) methane
- D-LECV Deutero Ethyl Crystal Violet; deutero-tris(4-diethylaminophenyl)methane
- LPCV tris(N,N-di-n-propylaminophenyl)methane=4,4',4"-methylidynetris(N,N-di-i-propyl)benzenamine
- LBCV tris(N,N-di-n-butylaminophenyl)methane=4,4',4"-methylidynetris(N,N-di-n-butyl)benzenamine
- D-LCV Deutero-Leuco Crystal Violet; deutero-tris(N,N-dimethylaminophenyl)methane
- LMG Leuco Malachite Green, 4,4'-(phenylmethylene)-bis[N,N-dimethylbenzenamine]
- TLA-454 4,4',4"-methylidynetris[N,N-diethyl-3-methyl-benzenamine]
- D-LV-1 deutero-bis(4-diethylaminophenyl)-(4-diethylamino-2-methylphenyl)methane Biimidazoles (HABIs)

- o-Cl-HABI 2,2'-bis(2-chlorophenyl)-4,4',5,5'-tetraphenyl-2',1'-bi-1H-imidazole
- o-OEt-HABI 2,2'-bis(2-ethoxyphenyl)4,4',5,5'-tetraphenyl-1,1'-bi-1H-imidazole
- o-Me HABI 2-(2-methylphenyl)-1-[2-(2-methylphenyl)-4,5-diphenyl-2H-imidazol-2-yl]-4,5-diphenyl-1H-imidazole Acid-Generating Compounds

- BMPS phenyl tribromomethyl sulfone
- DBTCE 1,2-dibromotetrachloroethane
- DBC dibromochalcone (dibromobenzylidene acetophenone)
- TCT tristrichloromethyltriazine Stabilizers

- BHT 2,6-di-t-butyl-4-methylphenol
- PD 1-phenyl-3-pyrazolidinone (Phenidone)
- DEHA N,N-diethylhydroxyamine
- DBHA N,N-dibenzylhydroxylamine UV Stabilizers (Absorbing significantly at wavelengths>380 nm)

- THBP 2,2',4,4'-tetrahydroxybenzophenone

Near IR-Absorbing Dyes

- DF-1 2-[2-[2-chloro-3-[(1,3-dihydro-1,3,3-trimethyl-2H-indol-2-ylidene)ethylidene]-1-cyclopenten-1-yl]ethenyl]-1,3,3-trimethyl-3H-indolium trifluoromethanesulfonate (see U.S. Pat. No. 4,882,265)

Polymeric Binders

- PVB Poly(vinyl butyral)
- Butvar® PVB from Monsanto, St. Louis, Mo.
- EAB-381-20 Cellulose acetate butyrate, from Eastman Chemical, Kingsport, Tenn.
- EAB-500-1 Cellulose acetate butyrate, from Eastman Chemical, Kingsport, Tenn.

The invention will now be further illustrated, but not limited, by the following examples.

EXAMPLES

Unless otherwise noted, all samples were prepared using a coating solution of 1:1:1 v/v/v methyl ethyl ketone: isopropyl alcohol: toluene (111 solvent blend). Coatings were prepared under yellow light with wire-wound rods (Meyer rods with wires wrapped around a core, available from RD Specialties, Inc. of Webster, N.Y.) on paper base (Reflections II, 90-lb. available from Consolidated Paper, Wisconsin Rapids, Wis.). Coatings were allowed to dry in air at ambient temperature.

Optical density measurements (RL) were carried out using an RD-918 Reflection densitomer (available from Macbeth Instruments, New Windsor, N.Y.) employing the visible (black) filter. All density measurements were nulled to the uncoated base paper.

Ambient light exposures were carried out under uniform normal fluorescent lighting at a measured intensity of 115±5 foot-candles (1240±60 cd/m$^2$).

Example 1

This example compares the effectiveness of DBHA in stabilizing LCV to ambient light in EAB-381-20 cellulose acetate butyrate based samples. As the amount of DBHA is increased relative to LCV the level of stabilization the films to ambient light initiated color formation is increased. In comparison samples containing equimolar amounts of DEHA show significantly less stabilization. Additionally the films prepared using DEHA showed significantly higher initial background densities indicating that DBHA also serves to increase solution stability prior to coating.

A stock solution was prepared containing 9.77 grams EAB-381-20 and 6.68 grams LCV dissolved in 222.6 grams 111 solvent blend. Coating solutions were prepared by adding the amounts listed in Table 1 to 20 gram aliquots of stock. Films were prepared using a #30 wire-wound rod (with ⅜-inch diameter core).

TABLE 1

| Sample | DBHA (mg) | DEHA (mg) | EAB-381-20 (mg) | Wt. % Stabilizer | Stabilizer: LCV Molar Ratio |
|---|---|---|---|---|---|
| 1-1 | — | — | 242.9 | 0 | 0.00 |
| 1-2 | 48.6 | — | 194.3 | 3 | 0.15 |
| 1-3 | 81.0 | — | 161.9 | 5 | 0.25 |
| 1-4 | 97.2 | — | 145.7 | 6 | 0.30 |
| 1-5 | 113.4 | — | 129.6 | 7 | 0.36 |
| 1-6 | 129.6 | — | 113.4 | 8 | 0.41 |
| 1-7 | 161.9 | — | 81.0 | 10 | 0.51 |
| 1-8 | 194.3 | — | 48.6 | 12 | 0.61 |
| 1-9 | 242.9 | — | — | 15 | 0.76 |
| 1-10 | — | 33.2 | 209.7 | 2 | 0.25 |
| 1-11 | — | 40.5 | 202.4 | 3 | 0.30 |

The resulting samples were exposed to ambient lighting for 17 hours and the resulting increases in background color were determined. The results are summarized in Table 2 where ΔARL is the change in optical density resulting from room light exposure:

TABLE 2

| Sample | Dark | Exposed | ΔRL |
|---|---|---|---|
| 1-1 | 0.40 | 0.71 | |
| 1-2 | 0.06 | 0.20 | 0.14 |
| 1-3 | 0.05 | 0.07 | 0.02 |
| 1-4 | 0.04 | 0.05 | 0.01 |
| 1-5 | 0.04 | 0.03 | −0.01 |
| 1-6 | 0.04 | 0.03 | −0.01 |
| 1-7 | 0.03 | 0.02 | −0.01 |
| 1-8 | 0.03 | 0.02 | −0.01 |
| 1-9 | 0.02 | 0.01 | −0.01 |
| 1-10 | 0.14 | 0.38 | 0.24 |
| 1-11 | 0.17 | 0.47 | 0.30 |

The data in Table 2 demonstrates that for samples containing more than about 0.25 molar equivalents of DBHA per mole of LCV, ambient light induced color formation is completely suppressed. In fact for values above 0.36 equivalents, backgrounds are actually slightly lower following room light exposure. In contrast, samples containing 0.25 and 0.30 molar equivalents of DEHA exhibit much poorer roomlight stability and higher initial density indicative of poor coating solution stability.

Example 2

This example demonstrates that DBHA is effective in stabilizing LCV to ambient light induced color formation in polyvinylbutyral based samples. The procedure was identical to that of Example 1, except BUTVAR B-90 was substituted for EAB-381-20. Table 3 below lists the samples prepared:

TABLE 3

| Sample | DBHA (mg) | DEHA (mg) | B-90 (mg) | Wt. % Stabilizer | Amine: LCV Molar Ratio |
|---|---|---|---|---|---|
| 2-1 | — | — | 242.9 | 0 | 0.00 |
| 2-2 | 48.6 | — | 194.3 | 3 | 0.15 |
| 2-3 | 81.0 | — | 161.9 | 5 | 0.25 |
| 2-4 | 97.2 | — | 145.7 | 6 | 0.30 |
| 2-5 | 113.4 | — | 129.6 | 7 | 0.36 |
| 2-6 | 129.6 | — | 113.4 | 8 | 0.41 |
| 2-7 | 161.9 | — | 81.0 | 10 | 0.51 |
| 2-8 | 194.3 | — | 48.6 | 12 | 0.61 |
| 2-9 | 242.9 | — | — | 15 | 0.76 |
| 2-10 | — | 33.2 | 209.7 | 2 | 0.25 |
| 2-11 | — | 40.5 | 202.4 | 3 | 0.30 |

Ambient light aging results (18 hour exposure) for the above samples are presented in Table 4 where ΔRL is the change in optical density resulting from room light exposure.

TABLE 4

| Sample | Dark | Exposed | ΔRL |
|---|---|---|---|
| 2-1 | 0.21 | 0.63 | 0.42 |
| 2-2 | 0.02 | 0.23 | 0.21 |
| 2-3 | 0.01 | 0.03 | 0.02 |
| 2-4 | 0.01 | 0.02 | 0.01 |
| 2-5 | 0.02 | 0.02 | 0.00 |
| 2-6 | 0.01 | 0.02 | 0.01 |
| 2-7 | 0.01 | 0.01 | 0.00 |
| 2-8 | 0.01 | 0.01 | 0.00 |
| 2-9 | 0.01 | 0.00 | −0.01 |

TABLE 4-continued

| Sample | Dark | Exposed | ΔRL |
|---|---|---|---|
| 2-10 | 0.01 | 0.19 | 0.18 |
| 2-11 | 0.01 | 0.12 | 0.11 |

The data in Table 4 demonstrates that for films containing more than about 0.25 molar equivalents of DBHA per mole of LCV, ambient light induced color formation is completely suppressed. In contrast, samples containing 0.25 and 0.30 molar equivalents of DEHA exhibit much poorer roomlight stability.

Example 3

This example demonstrates the ability of DBHA to stabilize a variety of leuco triarylmethane dyes to ambient light in the presence of photooxidant tribromomethylphenylsulfone (BMPS).

A stock solution consisting of 8.5 grams EAB-381-20 and 500 mg of BMPS dissolved in 115 grams if 111 solvent blend was prepared. To 10 gram aliquots of this stock were added the amount of leuco dye and stabilizer shown in Table 5. Samples were coated on Reflections II paper using a #30 wire-wound rod.

TABLE 5

| Sample | LECV (mg) | D-LECV (mg) | LV-1 (mg) | LV-2 (mg) | LCV (mg) | DBHA (mg) |
|---|---|---|---|---|---|---|
| 3-1 | 46.3 | | | | | |
| 3-2 | | 46.3 | | | | |
| 3-3 | | | 46.3 | | | |
| 3-4 | | | | 46.3 | | |
| 3-5 | | | | | 46.3 | |
| 3-6 | 49.5 | | | | | 49.5 |
| 3-7 | | 49.5 | | | | 49.5 |
| 3-8 | | | 49.5 | | | 49.5 |
| 3-9 | | | | 49.5 | | 49.5 |
| 3-10 | | | | | 49.5 | 49.5 |

The films were exposed to ambient light for a period of 50 hours. Background densities before and after exposure are presented in Table 6, where ΔRL is the change in optical density resulting from room light exposure.

TABLE 6

| Film | Dark | Exposed | ΔRL |
|---|---|---|---|
| 3-1 | 0.14 | 0.66 | 0.52 |
| 3-2 | 0.06 | 0.42 | 0.36 |
| 3-3 | 0.18 | 0.61 | 0.43 |
| 3-4 | 0.17 | 0.59 | 0.42 |
| 3-5 | 0.04 | 0.51 | 0.47 |
| 3-6 | 0.06 | 0.50 | 0.44 |
| 3-7 | 0.00 | 0.08 | 0.08 |
| 3-8 | 0.00 | 0.11 | 0.11 |
| 3-9 | 0.00 | 0.14 | 0.14 |
| 3-10 | 0.00 | 0.12 | 0.12 |

The data in Table 6 were used to calculate the ratio of the increase in background density without DBHA to that with DBHA in the sample. The results are presented in Table 7.

TABLE 7

| Leuco Dye | Stability Ratio |
|---|---|
| LECV | 1.18 |
| D-LECV | 4.50 |
| LV-1 | 3.91 |
| LV-2 | 3.00 |
| LCV | 3.92 |

The results presented in Table 6 demonstrate improved solution stability for all of the leuco dyes when DBHA is present as judged by lower initial background densities. The data in Table 7 demonstrates that for all except the extremely reactive leuco dye LECV, relative stability to ambient light is increased by mole than 3 times when the films contain 6% DBHA by weight. Even for LECV stability is increased by nearly 20%.

Example 4

This example compares the room light stability and imaging properties of infrared imageable samples stabilized with DBHA and DEHA.

A stock solution was prepared containing 2.68 g EAB-381-20, 3.10 g o-OEt HABI, 0.67 g BMPS, 0.67 g THBP, 0.54 g LCV and 0.175 g DF-1 dissolved in 103.5 of 111 solvent blend. To 15 gram aliquots of the stock solution were added the amounts of DEHA and DBHA shown in Table 8. The resulting solutions were coated on Reflections II paper using a #20 wire wound rod and air dried.

TABLE 8

| Sample | DBHA (mg) | DEHA (mg) | Wt. Fraction |
|---|---|---|---|
| 4-1 | 154.6 | — | 12.8% |
| 4-2 | 67.5 | — | 6.0% |
| 4-3 | 55.7 | — | 5.0% |
| 4-4 | — | 154.6 | 12.8% |
| 4-5 | — | 67.5 | 6.0% |
| 4-6 | — | 55.7 | 5.0% |

Following coating, the remaining solution was stored in the dark for 4 hours and the solutions were then recoated under the same conditions to give samples 4-1 R to 4-6R.

Samples were exposed to ambient light for a period of 13 hours and optical density changes were recorded. In addition, samples were exposed to 366 nm UV light for a period of 90 seconds (Dylux® Quick Print exposure unit) and the resulting optical density changes were recorded. Results are summarized in Tables 9 and 9R where ΔRL is the change in optical density resulting from room light exposure and ΔUV is the corresponding change resulting from UV exposure.

TABLE 9

| Sample | Dark | RL Exposed | ΔRL | UV Exposed | ΔUV |
|---|---|---|---|---|---|
| 4-1 | 0.10 | 0.22 | 0.12 | 0.26 | 0.16 |
| 4-2 | 0.10 | 0.27 | 0.17 | 0.33 | 0.23 |
| 4-3 | 0.10 | 0.38 | 0.28 | 0.38 | 0.28 |
| 4-4 | 0.16 | 0.39 | 0.23 | 0.45 | 0.29 |
| 4-5 | 0.12 | 0.62 | 0.50 | 0.50 | 0.38 |
| 4-6 | 0.11 | 0.71 | 0.60 | 0.50 | 0.39 |

TABLE 9R

| Sample | Dark | RL Exposed | ΔRL | UV Exposed | ΔUV |
|---|---|---|---|---|---|
| 4-1R | 0.11 | 0.23 | 0.12 | 0.26 | 0.15 |
| 4-2R | 0.11 | 0.29 | 0.18 | 0.33 | 0.22 |
| 4-3R | 0.11 | 0.40 | 0.29 | 0.37 | 0.26 |
| 4-4R | 0.22 | 0.39 | 0.17 | 0.46 | 0.24 |
| 4-5R | 0.14 | 0.62 | 0.48 | 0.50 | 0.36 |
| 4-6R | 0.13 | 0.62 | 0.49 | 0.50 | 0.37 |

Table 10 summarizes the comparative room light stabilities of the DEHA and DBHA containing films. Results are expressed as the ratios:

R(ΔRL)=ΔRL(DEHA)/ΔRL(DBHA)

R(ΔUV)=ΔUV(DEHA)/ΔUV(DBHA)

R(Dark)=Dark(DEHA)/Dark(DBHA)

TABLE 10

| Stabilizer, Wt. Fraction | R(ΔOD) (fresh) | R(ΔOD) (@4 hr) | R(ΔUV) (fresh) | R(ΔUV) (@4 hr) | R(Dark) (fresh) | R(Dark) (@4 hr) |
|---|---|---|---|---|---|---|
| 12.8% | 1.9 | 1.4 | 1.8 | 1.6 | 1.6 | 2.0 |
| 6.0% | 2.9 | 2.7 | 1.7 | 1.6 | 1.2 | 1.3 |
| 5.0% | 2.1 | 1.7 | 1.4 | 1.4 | 1.1 | 1.2 |

The results in Table 10 show that in all cases samples stabilized with equivalent weights of DBHA are significantly more stable to both room light and UV light than are DEHA containing films. In addition the DBHA stabilized samples show desirable lower initial background color and exhibit greater solution stability as evidenced by lower background color change for aged solutions.

Table 11 presents the result of imaging the above samples using a CREO 3244 Trendsetter (Creo Products Inc., Burnaby, British Columbia, Canada) operating at a nominal near infrared exposure wavelength of 830 nm. The Trendsetter images with 192 beams with a nominal pixel size of 5 micron×10 micron with ca. 40 mW/beam. In addition to the near infrared imaging, samples were also imaged thermally by briefly (2–3 seconds) contacting the uncoated side of the film to a Weller WTCP Series TC202 soldering iron maintained at a temperature of 370° C. As shown in Table 11, all of the samples exhibit imaged optical densities (OD) in excess of 1.0 OD at exposure levels of 275 mJ/cm$^2$ or more.

TABLE 11

| Trendsetter Exposure (mJ/cm$^2$) | 4-1 | 4-2 | 4-3 | 4-4 | 4-5 | 4-6 |
|---|---|---|---|---|---|---|
| 0 | 0.11 | 0.11 | 0.11 | 0.17 | 0.13 | 0.11 |
| 150 | 0.20 | 0.23 | 0.25 | 0.25 | 0.28 | 0.31 |
| 175 | 0.34 | 0.38 | 0.43 | 0.38 | 0.46 | 0.45 |
| 200 | 0.54 | 0.61 | 0.66 | 0.58 | 0.67 | 0.65 |
| 225 | 0.71 | 0.79 | 0.83 | 0.75 | 0.83 | 0.80 |
| 250 | 0.90 | 0.95 | 0.98 | 0.91 | 1.00 | 0.97 |
| 275 | 1.00 | 1.07 | 1.12 | 1.05 | 1.12 | 1.07 |
| 300 | 1.08 | 1.18 | 1.23 | 1.17 | 1.18 | 1.19 |
| 350 | 1.25 | 1.30 | 1.32 | 1.32 | 1.35 | 1.34 |
| 400 | 1.31 | 1.37 | 1.42 | 1.39 | 1.41 | 1.39 |
| 450 | 1.24 | 1.28 | 1.27 | 1.32 | 1.27 | 1.30 |
| 500 | 1.23 | 1.20 | 1.19 | 1.29 | 1.21 | 1.22 |
| 550 | 1.20 | 1.12 | 1.15 | 1.19 | 1.19 | 1.19 |
| 600 | 1.14 | 1.09 | 1.11 | 1.18 | 1.15 | 1.17 |
| Thermal | 1.47 | 2.04 | 2.03 | 2.19 | 2.10 | 2.17 |

Example 5

A series of solutions were prepared to demonstrate the effect of DBHA vs. other known stabilizers in systems containing LCV, HABI, BMPS.

Solutions were coated with a #29 wire-wound rod (with 0.5-inch diameter core) on Reflections II paper. Samples were exposed in roomlight for the indicated time period. Samples were also heated to demonstrate thermal color forming capability. Table 12 shows the composition of the coating solutions used and the stability data of the image formed.

TABLE 12

| INGREDIENTS COATING SOLUTIONS | AMOUNT (% BY WEIGHT) | | | | | | |
|---|---|---|---|---|---|---|---|
| | A | B | BB | C | CC | D | DD |
| Methylene chloride | 82.44 | 82.19 | 82.08 | 81.84 | 81.73 | 81.48 | 81.37 |
| Propanol-2 | 9.14 | 9.14 | 9.14 | 9.14 | 9.14 | 9.14 | 9.14 |
| EAB 500-1 | 5.85 | 5.85 | 5.85 | 5.85 | 5.85 | 5.85 | 5.85 |
| Leuco Crystal Violet | 1.17 | 1.17 | 1.17 | 1.17 | 1.17 | 1.17 | 1.17 |
| o-Cl-HABI | 1.17 | 1.17 | 1.17 | 1.17 | 1.17 | 1.17 | 1.17 |
| Phenyl tribromomethyl sulfone | 0.23 | 0.23 | 0.23 | 0.23 | 0.23 | 0.23 | 0.23 |
| DBHA | | 0.25 | 0.11 | | | | |
| Phenidone | | | | 0.25 | 0.11 | | |
| BHT (2,6-di-t-butyl)-4-methyl phenol) | | | | | | 0.25 | 0.11 |
| Δ OD 2.5 hrs. RL | 0.75 | 0 | 0.04 | 0.09 | 0.29 | 0.11 | 0.25 |
| Δ OD Heating | 1.66 | 1.67 | 1.61 | 1.58 | 1.51 | 1.75 | 1.77 |

The results in Table 12 show that DBHA was surprisingly more effective at lower concentrations than previously reported phenidone or BHT in this system.

When the compositions reported above are encapsulated in the manner described in Fuji's U.S. Pat. No. 4,942,107, in which the capsules contain inert organic solvent as reaction medium, but no binder, similar results are anticipated.

Example 6

Solutions composed as below were coated with a #29 wire-wound rod on Reflections II paper. These samples were exposed in roomlight for the indicated time period. Samples were also heated to demonstrate thermal color forming capability.

Compositions containing Malachite Green and DBTCE were found to be stabilized by the addition of DBHA. Table 13 shows the composition of the coating solutions used and the stability data of imaged formed.

TABLE 13

| Ingredients | Control (amount by Wt %) | Comparative Sample (Amount by Wt %) |
|---|---|---|
| Methylene chloride | 84.91 | 84.26 |
| Methanol | 6.39 | 6.342 |
| EAB 500-1 | 7.30 | 7.30 |
| Leuco Malachite Green | 0.70 | 0.70 |
| DBTCE | 0.70 | 0.70 |
| DBHA | | 0.70 |
| ΔOD 10 hrs. RL | 0.14 | 0.03 |
| ΔOD Heating | 0.47 | 0.28 |

The results in Table 13 show that surprisingly, DBHA can be used as a stabilizer for at least one leuco dye imaging system.

Example 7

Solutions composed as below were coated with a #29 wire-wound rod on Reflections II paper. These samples were exposed in roomlight for indicated time period. Samples were also heated to demonstrate thermal color forming capability.

Compositions containing Leuco Crystal Violet and DBTCE were found to be stabilized by the addition of DBHA. Table 14 shows the composition of the coating solutions used and the stability data of imaged formed.

TABLE 14

| Ingredients | Control (Wt. %) | Comparative Sample (Wt. %) |
|---|---|---|
| Methylene chloride | 84.85 | 84.04 |
| Methanol | 6.39 | 6.78 |
| EAB 500-1 | 7.29 | 7.29 |
| LCV | 0.73 | 0.73 |
| DBTCE | 0.73 | 0.73 |
| DBHA | | 0.43 |
| ΔOD 2 hrs. RL | 0.74 | 0.05 |
| ΔOD Heating | 1.59 | 0.88 |

The data in Table 14 shows that, surprisingly, DBHA is a stabilizer for a LCV/DBTCE imaging system.

Example 8

Solutions composed as below were coated with a #29 wire-wound rod on Reflections II paper. These samples were exposed in roomlight for indicated time period. Samples were also heated to demonstrate thermal color forming capability.

Compositions containing TLA-454 and BMPS were found to be stabilized by the addition of DBHA. Table 15 shows the composition of the coating solutions used and the stability data of imaged formed.

TABLE 15

| | | |
|---|---|---|
| Methylene chloride | 84.78 | 84.05 |
| Methanol | 6.38 | 6.33 |
| EAB 500-1 | 7.28 | 7.28 |
| TLA-454 | 0.78 | 0.78 |
| BMPS | 0.78 | 0.78 |
| DBHA | | 0.78 |
| ΔOD 10 hrs. PL | 0.04 | 0 |
| ΔOD Heating | 0.44 | 0.31 |

Of course, it should be understood that a wide range of changes and modifications can be made to the preferred embodiment described above. It therefore is intended that the foregoing detailed description be regarded as illustrative rather than limiting and that it be understood that it is the following claims, including all equivalents, which are intended to define the scope of this invention.

What is claimed is:

1. In a method for improving stability of a thermally imageable monochrome product including at least one oxidant, at least one IR-absorbing dye, an the oxidant being selected from the group consisting of a _biimidazole compound; and at least one leuco dye selected from the group consisting of aminotriarylmethanes; aminooxanthenes; aminothioxanthenes; amino-9,10-dihydroacridines, aminophenoxazines; aminophenothiazines; aminodihydropheazines; aminohydrocinnamic acids; esters of aminohydrocinnamic acids; 2(p-hydroxyphenyl)-4,5-diphenylimidaxoles; inadanones and combinations thereof wherein the improvement comprises incorporating in the product at least one hydroxylamine compound selected from the group consisting of:

(i) compounds having the following structure:

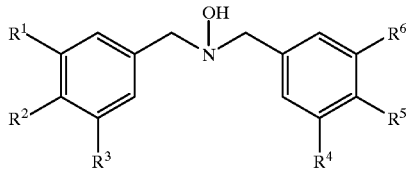

wherein $R^1$–$R^6$ are independently selected from hydrogen atom; hydroxyl group; amino group; $C_1$–$C_6$ alkyl group; $C_1$–$C_6$ alkoxy group; halogen atom or $NO_2$; and wherein any two adjacent $R_1$ through $R_3$ and any two adjacent $R_4$ through $R_6$ may form a fused aryl ring; and (ii) compounds having the following structure:

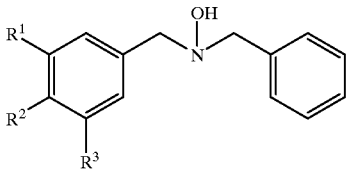

wherein $R^1$ through $R^3$ are independently selected from hydrogen atom; hydroxyl group; amino group $C_1$–$C_6$ alkyl; $C_1$–$C_6$ alkoxy; halogen atom or $NO_2$; and wherein any two adjacent $R^1$ through $R^3$ may form a fused aryl ring; and (iii) combinations of (i) and (ii).

2. The method of claim 1 wherein the product further includes at least one polymeric binder.

3. The method of claim 1 wherein the product further includes an inert medium and wherein at least the inert organic medium, the leuco dye and the hydroxylamine compound are encapsulated.

4. In a thermally imageable composition having (a) a near IR absorbing dye; (b) a biimidazole compound; (c) a leuco dye selected from the group consisting of aminotriarylmethane; aminooxoanthenes; aminothioxanthenes; amino-9,10-dihydroacridines; aminophenoxazines; aminophenothiazines; aminodihydrophenazines; aminohydrocinnamic acids; esters of aminohydrocinnamic acids; 2(p-hydroxyphenyl)-4,5-diphenylimidazoles; indanones and combinations thereof; (d) an acid-generating compound; and (e) a polymeric binder, the improvement comprising incorporating in the composition: a hydroxylamine compound selected from the group consisting of (i) compounds having the following structure:

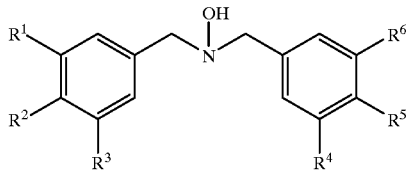

wherein $R^1$–$R^6$ are independently selected from hydrogen atom; hydroxyl group; amino group; $C_1$–$C_6$ alkyl group; $C_1$–$C_6$ alkoxy group; halogen atom or $NO_2$; and wherein any two adjacent $R_1$ through $R_3$ and any two adjacent $R_4$ through $R_6$ may form a fused aryl ring; and (ii) compounds having the following structure

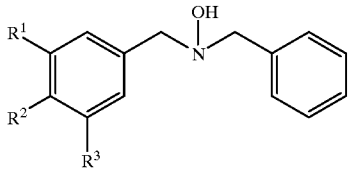

wherein $R^1$ through $R^3$ are independently selected from hydrogen atom; hydroxyl group; amino group $C_1$–$C_6$ alkyl; $C_1$–$C_6$ alkoxy; halogen atom or $NO_2$; and wherein any two adjacent $R^1$ through $R^3$ may form a fused aryl ring;

and (iii) combinations of (i) and (ii).

5. The composition of claim 4 in which the binder is selected from the group consisting of acrylic homopolymers, acrylic copolymers, methacrylic homopolymers, methacrylic copolymers, poly(vinyl butyral), cellulose esters, poly(alkylene oxides), poly(styrene) homopolymers and poly(styrene) copolymers and combinations thereof.

6. The composition of claim 4 in which the binder is poly(vinyl butyral).

7. The composition of claim 4 in which the binder is a cellulose acetate ester.

8. The composition of claim 4 in which the leuco dye is tris(N,N-dimethylaminophenyl)methane.

9. The composition of claim 4 in which the leuco dye is bis(4-diethylaminophenyl)-(4-diethylamino-2-methylphenyl) methane.

10. The composition of claim 4 in which the leuco dye is Leuco Crystal Violet.

11. The composition of claim 4 further comprising at least one UV stabilizer.

12. The composition of claim 4 in which the UV stabilizer is absorbs at a wavelength greater than or equal to about 380 nm.

13. The composition of claim 4 in which the UV stabilizer is selected from the group consisting of polyhydroxybenzophenones, triarylimidazoles and hydroxyphenylbenzotriazoles and combinations thereof.

14. The composition of claim 4 in which the UV stabilizer is selected from the group consisting of 4,4'-dimethoxy-2,2'-dihydroxybenzophenone; 4,4'-dimethoxy-2,2'-dihydroxybenzophenone; 2,2',4,4'-tetrahydroxybenzophenone; 2,2'4,4'-tetrahydroxy-5,5'di-t-butylbenxophenone; 2,2'dihydroxy-4-methoxybenzophenone; and 4,5-diphenyl-2(o-chlorophenyl)imidazole and combinations thereof.

15. The composition of claim 4 in which the near IR-absorbing dye is 2-[2-[2-chloro-3-[(1,3-dihydro-1,3,3-trimethyl-2H-indol-2-ylidene)ethylidene]-1-cyclopenten-1-yl]ethenyl]-1,3,3-trimethyl-3H-indolium trifluoromethanesulfonate.

16. In a thermally imageable composition having (a) a near IR absorbing dye; (b) a biimidazole compound; (c) a leuco dye selected from the group consisting of tris(N,N-dimethylaminophenyl)methane; bis(4-diethylaminophenyl)-(4-diethylamino-2-methyl-phenyl)methane; deutero-tris(4-diethylaminophenyl)methane; deutero-tris(N,N-dimethylaminophenyl)methane; and deutero-bis(4-diethylaminophenyl)-(4-diethylamino-2-methylphenyl) methane and combinations thereof; wherein the improvement comprises incorporating in the composition at least one hydroxylamine compound selected from the group consisting of:

(i) compounds having the following structure:

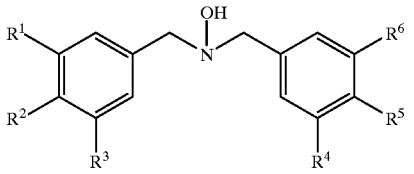

wherein $R^1$–$R^6$ are independently selected from hydrogen atom; hydroxyl group; amino group; $C_1$–$C_6$alkyl group; $C_1$–$C_6$ alkoxy group; halogen atom or $NO_2$; and wherein any two adjacent $R_1$ through $R_3$ and any two adjacent $R_4$ through $R_6$ may form a fused aryl ring; and (ii) compounds having the following structure

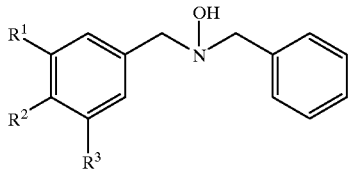

wherein $R^1$ through $R^3$ are independently selected from hydrogen atom; hydroxyl group; amino group $C_1$–$C_6$ alkyl; $C_1$–$C_6$ alkoxy; halogen atom or $NO_2$; and wherein any two adjacent $R^1$ through $R^3$ may form a fused aryl ring;

and (iii) combinations of (i) and (ii).

17. The composition of claim 16 further comprising a binder in which the binder is selected from the group consisting of acrylic homopolymers, acrylic copolymers, methacrylic homopolymers, methacrylic copolymers, poly (vinyl butyral), cellulose esters, poly(alkylene oxides), poly (styrene) homopolymers and poly(styrene) copolymers and combinations thereof.

18. The composition of claim 17 in which the binder is poly(vinyl butyral).

19. The composition of claim 17 in which the binder is a cellulose acetate ester.

20. The composition of claim 16 in which the leuco dye is tris(N,N-dimethylaminophenyl)methane.

21. The composition of claim 16 in which the leuco dye is bis(4-diethylaminophenyl)-(4-diethylamino-2-methylphenyl) methane.

22. The composition of claim 16 in which the leuco dye is Leuco Crystal Violet.

23. The composition of claim 16 further comprising at least one UV stabilizer.

24. The composition of claim 23 in which the UV stabilizer absorbs at a wavelength greater than or equal to about 380 nm.

25. The composition of claim 23 in which the UV stabilizer is selected from the group consisting of polyhydroxybenzophenones, triarylimidazoles and hydroxyphenylbenzotriazoles and combinations thereof.

26. The composition of claim 23 in which the UV stabilizer is selected from the group consisting of 4,4'-dimethoxy-2,2'-dihydroxybenzophenone; 4,4'-dimethoxy-2,2'-dihydroxybenzophenone; 2,2',4,4'-tetrahydroxybenzophenone; 2,2'4,4'-tetrahydroxy-5,5'di-t-butylbenzophenone; 2,2'dihydroxy-4-methoxybenzophenone; and 4,5-diphenyl-2(o-chlorophenyl)imidazole and combinations thereof.

27. The composition of claim 23 in which the near IR-absorbing dye is 2-[2-[2-chloro-3-[(1,3-dihydro-1,3,3-trimethyl-2H-indol-2-ylidene)ethylidene]-1-cyclopenten-1-yl]ethenyl]-1,3,3-trimethyl-3H-indolium trifluoromethanesulfonate.

* * * * *